US007454798B2

(12) United States Patent
Feodoroff

(10) Patent No.: US 7,454,798 B2
(45) Date of Patent: Nov. 25, 2008

(54) MEDICAL GARMENT AND RELATED METHOD

(76) Inventor: Margaret M. Feodoroff, 50 Brentwood Dr., North Easton, MA (US) 02356

( * ) Notice: Subject to any disclaimer, the term of this patent is extended or adjusted under 35 U.S.C. 154(b) by 0 days.

(21) Appl. No.: 11/399,631

(22) Filed: Apr. 6, 2006

(65) Prior Publication Data

US 2007/0245450 A1 Oct. 25, 2007

(51) Int. Cl.
*A41B 9/00* (2006.01)
*A41D 10/00* (2006.01)

(52) U.S. Cl. ..... 2/114

(58) Field of Classification Search ..... 2/104, 2/114, 115, 227, 269, 919, DIG. 1
See application file for complete search history.

(56) References Cited

U.S. PATENT DOCUMENTS 0,302,901 A 8/1884 Fenne
1,206,480 A * 11/1916 Stagg ..... 2/104
1,998,051 A * 4/1935 Gerber ..... 2/114
3,611,439 A * 10/1971 Meyers ..... 2/54
4,004,294 A * 1/1977 Pinch ..... 2/104
4,031,566 A * 6/1977 Johnson ..... 2/104
4,144,593 A * 3/1979 Timmons ..... 2/104
4,513,451 A * 4/1985 Brown ..... 2/69
4,663,782 A * 5/1987 Knox et al. ..... 2/104
4,713,842 A * 12/1987 Patterson ..... 2/104
4,759,083 A * 7/1988 Belcher ..... 2/114
4,914,756 A * 4/1990 Grassick ..... 2/227
4,920,578 A * 5/1990 Janzen et al. ..... 2/114
5,008,962 A * 4/1991 Smith et al. ..... 2/234
5,084,914 A * 2/1992 Hesch ..... 2/79
5,093,932 A * 3/1992 Doyle ..... 2/114
5,097,535 A * 3/1992 Dye et al. ..... 2/69
5,097,536 A * 3/1992 Cohen ..... 2/114
5,133,086 A * 7/1992 Truitt et al. ..... 2/114
5,191,659 A * 3/1993 Backus ..... 2/227
5,222,258 A * 6/1993 Mucci et al. ..... 2/114
5,331,685 A * 7/1994 Belgard ..... 2/79
5,440,763 A * 8/1995 Shah et al. ..... 2/114
5,454,119 A * 10/1995 Thomm ..... 2/114
5,564,126 A * 10/1996 Chou ..... 2/114
5,611,087 A * 3/1997 Adkins ..... 2/114
5,706,523 A * 1/1998 Witzel ..... 2/238
5,752,277 A * 5/1998 van der Sleesen ..... 2/69
5,799,330 A * 9/1998 O'Donoghue-Kitt ..... 2/114
5,802,611 A * 9/1998 McKenzie et al. ..... 2/69

(Continued)

*Primary Examiner*—Gary L Welch
*Assistant Examiner*—Amber R Anderson
(74) *Attorney, Agent, or Firm*—Lowrie, Lando & Anastasi, LLP

(57) ABSTRACT

A medical garment is configured to be worn by a patient requiring medical attention. The medical garment includes a blouse portion including fabric material configured to cover an upper torso and arms of the patient when worn. The medical garment further includes a body part access panel formed in the fabric material adjacent a body part of the patient when worn. The body part access panel is movable between a closed position in which the body part access panel is releasably secured to the fabric material and an open position in which the body part access panel is moved away from the fabric material to allow access to the body part of the patient. Other embodiments of the medical garment and a method of performing a medical examination on a patient are further disclosed.

9 Claims, 13 Drawing Sheets

U.S. PATENT DOCUMENTS 5,822,802 A * 10/1998 Chou ..... 2/227
5,887,279 A * 3/1999 Elting et al. ..... 2/69
5,946,722 A * 9/1999 Trautmann ..... 2/83
6,085,353 A * 7/2000 van der Sleesen ..... 2/69
6,154,883 A * 12/2000 Spann et al. ..... 2/69
6,216,270 B1 * 4/2001 Moquin et al. ..... 2/69
6,240,563 B1 * 6/2001 Niedermeyer ..... 2/114
6,272,685 B1 * 8/2001 Kumar ..... 2/114
6,339,845 B1 * 1/2002 Burns et al. ..... 2/243.1
6,367,082 B1 * 4/2002 Mina ..... 2/69
6,438,758 B1 * 8/2002 Burkard et al. ..... 2/115
6,647,552 B1 * 11/2003 Hogan ..... 2/114
6,687,919 B2 * 2/2004 Dilworth et al. ..... 2/457
6,745,400 B1 * 6/2004 Paciorkowski ..... 2/69
6,792,622 B2 * 9/2004 Graves ..... 2/114
6,799,332 B2 * 10/2004 Hatton ..... 2/114
6,883,178 B2 * 4/2005 van der Sleesen ..... 2/69
7,181,773 B1 * 2/2007 Piraka ..... 2/114
2001/0004771 A1 * 6/2001 Chou ..... 2/227
2001/0044948 A1 * 11/2001 Tolson ..... 2/114
2002/0032921 A1 * 3/2002 Thompson et al. ..... 2/104
2002/0040496 A1 * 4/2002 Blaire ..... 2/227
2004/0237168 A1 * 12/2004 Braun ..... 2/93
2005/0257309 A1 * 11/2005 Knoefel et al. ..... 2/114
2006/0008643 A1 * 1/2006 Lin et al. ..... 428/364
2006/0031976 A1 * 2/2006 Nwawka ..... 2/114

* cited by examiner

FIG. 5
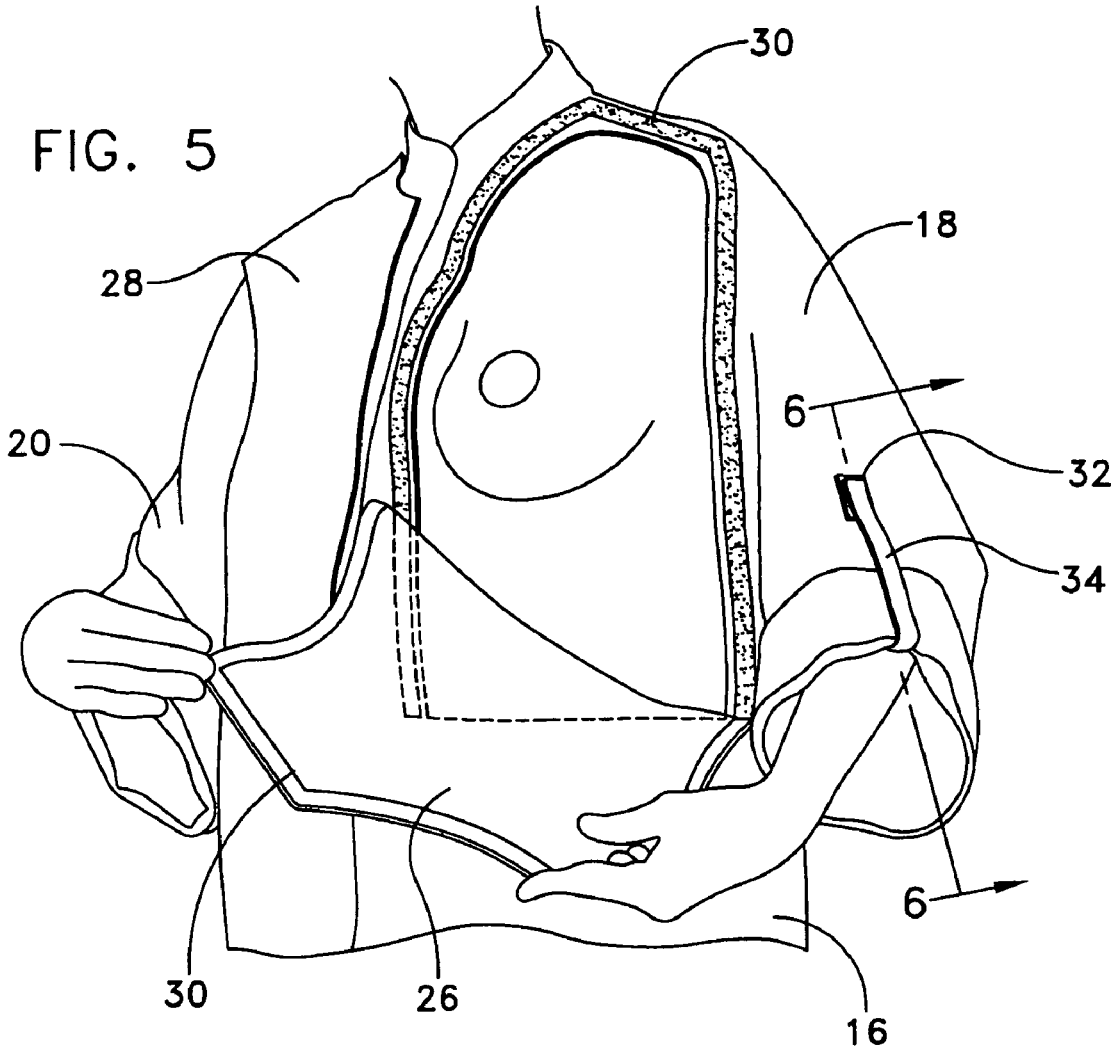
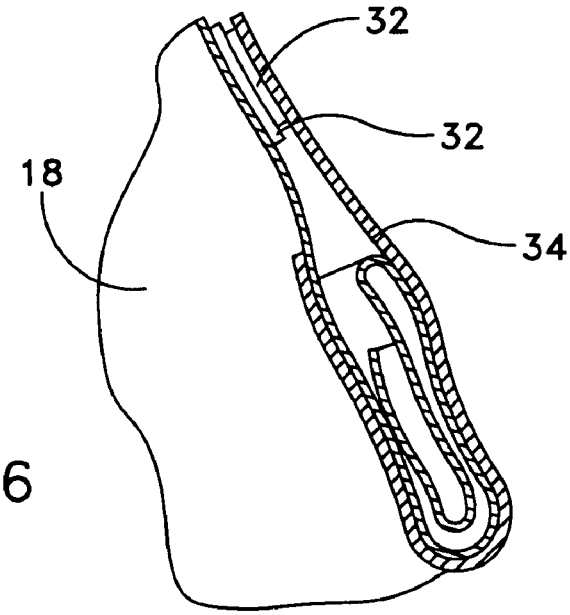
FIG. 6

MEDICAL GARMENT AND RELATED METHOD

BACKGROUND OF THE INVENTION

1. Field of the Invention

The present invention relates generally to garments, and more particularly to a medical garment adapted to be worn by a patient requiring medical attention, such as a medical examination.

2. Discussion of Related Art

Traditionally, a patient undergoing a medical examination, such as a breast examination, must wear a hospital garment. Such garments, sometimes referred to as "johnnies," are often fabricated from throw-away material, such as paper, and are designed to fit loosely over the patient. In use, the hospital garment generally covers the front of the patient, but leaves the backside of the patient at least partially exposed.

Traditional hospital garments are generally embarrassing to wear. For a patient requiring frequent medical treatment, such as a cancer patient requiring chemotherapy, the wearing of a hospital garment can be an unwanted reminder of the patient's medical issue. There is presently a need for a medical garment that offers a more dignified appearance but is constructed to enable medical personnel to conduct examinations and minor medical procedures.

SUMMARY OF THE INVENTION

One aspect of the invention is directed to a medical garment adapted to be worn by a patient requiring medical attention. The medical garment comprises a blouse portion including fabric material configured to cover at least a portion of an upper torso and arms of the patient when worn. The medical garment further comprises a body part access panel formed in the fabric material adjacent a body part of the patient when worn. The body part access panel is movable between a closed position in which the body part access panel is releasably secured to the fabric material and an open position in which the body part access panel is moved away from the fabric material to allow access to the body part of the patient.

Embodiments to the medical garment further include the provision of a fastener to releasably secure the body part access panel in its closed position. In one embodiment, the fastener comprises hook and loop material provided on the fabric material and the body part access panel. In a certain embodiment, the body part access panel is a breast access panel formed in the fabric material adjacent a breast of the patient when worn. The medical garment may further comprise a slit formed in the fabric material adjacent a back of the patient when worn, and a fastener to releasably secure the slit in a closed position. In one embodiment, fastener comprises hook and loop material provided on the fabric material. A fastener may be provided to secure sleeves of the blouse portion in a rolled-up position. The medical garment may further comprise a pants portion including fabric material configured to cover at least a portion of a lower torso and legs of the patient when worn. The pants portion includes a slit formed in an outer seam of the fabric material, and a fastener to releasably secure the slit in a closed position. In one embodiment, the fastener comprises hook and loop material provided on the fabric material.

Another aspect of the invention is directed to a medical garment adapted to be worn by a patient requiring medical attention. The medical garment comprises a blouse portion including fabric material configured to cover at least a portion of an upper torso and arms of the patient when worn, a slit formed in the fabric material adjacent a body part of the patient when worn, and a fastener to releasably secure the slit in a closed position.

Embodiments of the medical garment may comprise the fastener having hook and loop material provided on the fabric material. The medical garment further comprises a breast access panel formed in the fabric material adjacent a breast of the patient when worn. In one embodiment, the breast access panel is movable between a closed position in which the breast access panel is releasably secured to the fabric material and an open position in which the breast access panel is moved away from the fabric material to allow access to the breast of the patient. The medical garment may further comprise a fastener to releasably secure the breast access panel in its closed position. The fastener comprises hook and loop material provided on the fabric material and the breast access panel. A fastener may be provided to secure sleeves of the blouse portion in a rolled-up position. The medical garment further includes a pants portion including fabric material configured to cover at least a portion of a lower torso and legs of the patient when worn. In a certain embodiment, the pants portion further comprises a slit formed in an outer seam of the fabric material, and a fastener to releasably secure the slit in a closed position. The fastener comprises hook and loop material provided on the fabric material.

Yet another aspect of the invention is directed to a medical garment adapted to be worn by a patient requiring medical attention. In this embodiment, the medical garment comprises a pants portion including fabric material configured to cover at least a portion of a lower torso and legs of the patient when worn, a slit formed in an outer seam of the fabric material, and a fastener to releasably secure the slit in a closed position.

Embodiments of the medical device may include the fastener having hook and loop fastener material provided on the fabric material. A draw string may be provided in a closed loop formed in the fabric material adjacent the lower torso of the patient when worn. The draw string is adapted to cinch the pants portion around the lower torso of the patient.

A further aspect of the invention is directed to a method of performing a medical examination of a patient. The method comprises donning a medical garment on a patient. The medical garment comprises a blouse portion top including fabric material configured to cover at least a portion of an upper torso and arms of the patient when worn, and a body part access panel formed in the fabric material adjacent a body part of the patient. The body part access panel is movable between a closed position in which the body part access panel is releasably secured to the fabric material and an open position in which the body part access panel is moved away from the fabric material to allow access to the body part of the patient. The method further comprises moving the body part access panel to its open position, accessing the body part of the patient through the body part access panel, and performing a body part examination on the patient, which in certain embodiments, may include performing a breast examination.

DESCRIPTION OF THE DRAWINGS

For a better understanding of the present invention, reference is made to the drawing figures which are incorporated herein by reference and in which:

FIG. 5 is a front perspective view of the blouse shown in FIG. 4 as worn;

FIG. 6 is a cross-sectional view of a sleeve of the blouse taken along line 6-6 of FIG. 5;

DETAILED DESCRIPTION OF THE INVENTION

Figure 1:
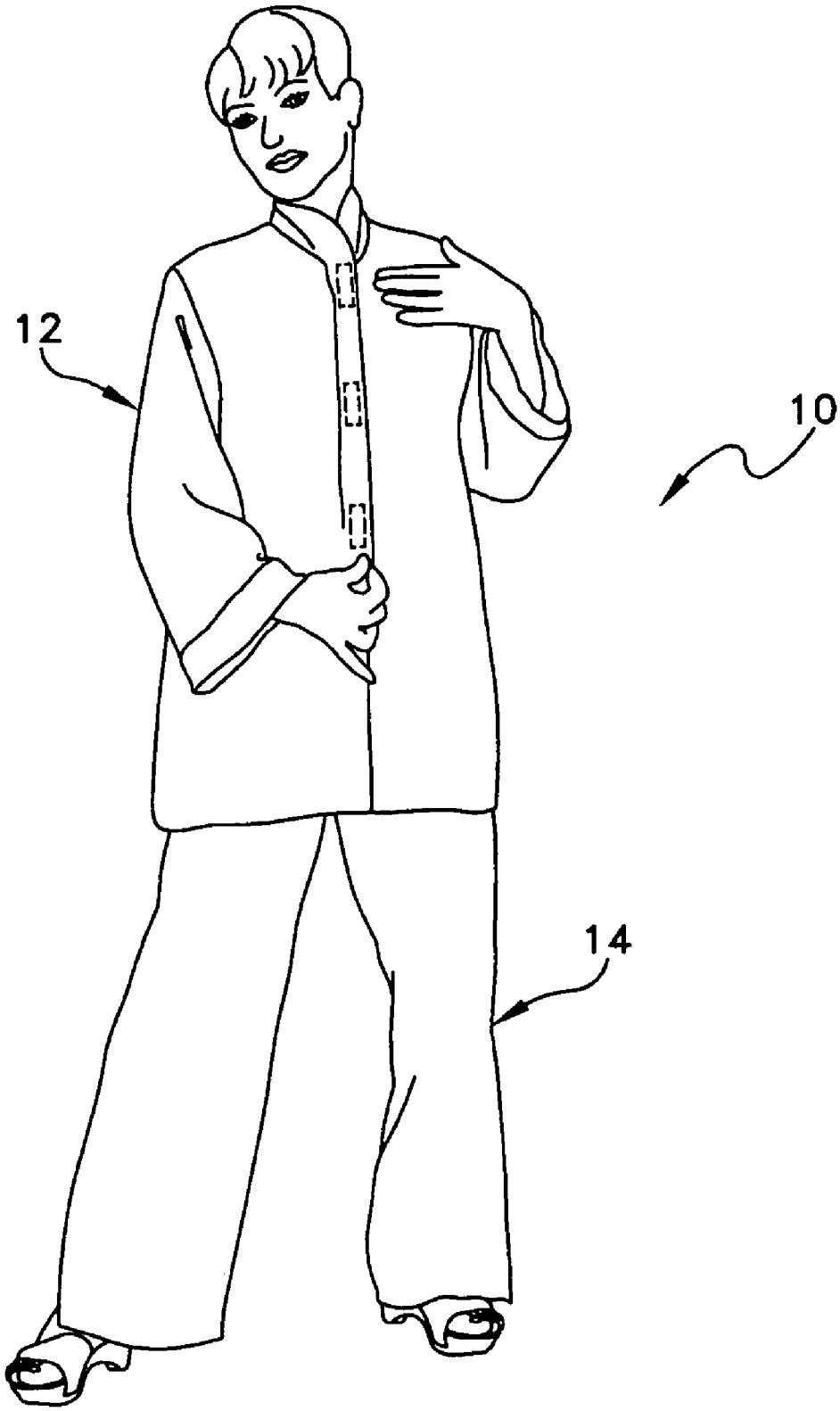
FIG. 1 is a front perspective view of a medical garment of an embodiment of the present invention as worn.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Embodiments of the present invention are designed to replicate clothing worn for day-to-day activities. In a certain embodiment, the medical garment may include a blouse that is fabricated from fabric material configured to cover an upper torso and arms of the patient when worn. The blouse may be easily worn and removed by the patient by the provision of one or more hook and loop fasteners provided at the front of the blouse. The blouse may be further configured to enable the quick and easy examination of a designated body part. In a certain example, two breast access panels may be formed in the fabric material adjacent the breasts of the patient when worn. Each breast access panel may be movable between a closed position in which the breast access panel is releasably secured to the fabric material and an open position in which the breast access panel is moved away from the fabric material to allow access to the breast of the patient. Other features may be further designed into the blouse. For example, in one embodiment, a slit may be formed in the fabric material adjacent the patient's back, and a device of hook and loop fastener material may be provided to releasably secure the slit in a closed position. In another embodiment, a device, also incorporating hook and loop fastener material, may be provided to secure sleeves of the blouse portion in a rolled-up position. This configuration enables a patient to easily roll up her sleeves and secure them in a rolled-up position without taking off the blouse.

Other embodiments of the medical garment are directed to pants including fabric material configured to cover a lower torso and legs of the patient when worn. The pants include a slit formed in an outer seam of the fabric material, and a device, such as a hook and loop fastener, to releasably secure the slit in a closed position. This construction enables medical personnel to have quick and easy access to a lower extremity of the patient, such as the patient's knee. The pants are also easy to put on and take off.

Referring now to the drawings, and more particularly to FIG. 1, there is generally indicated at 10 a medical garment of an embodiment of the invention. As shown, the medical garment 10 includes a blouse, generally indicated at 12, and pants, generally indicated at 14. The medical garment 10 may be fabricated from any suitable fabric, such as cotton, polyester, rayon, blends of the foregoing, etc. For example, extra soft microfiber material may be used for added comfort to the patient. In addition, the fabric may be stain-resistant. As shown, and as will be discussed in greater detail below, the medical garment 10 is designed to replicate clothing a person wears during a typical day. The medical garment 10 is constructed to provide the wearer a certain amount of additional comfort as compared to traditional medical garments, while enabling the wearer to endure medical examinations or treatments.

Figure 2:
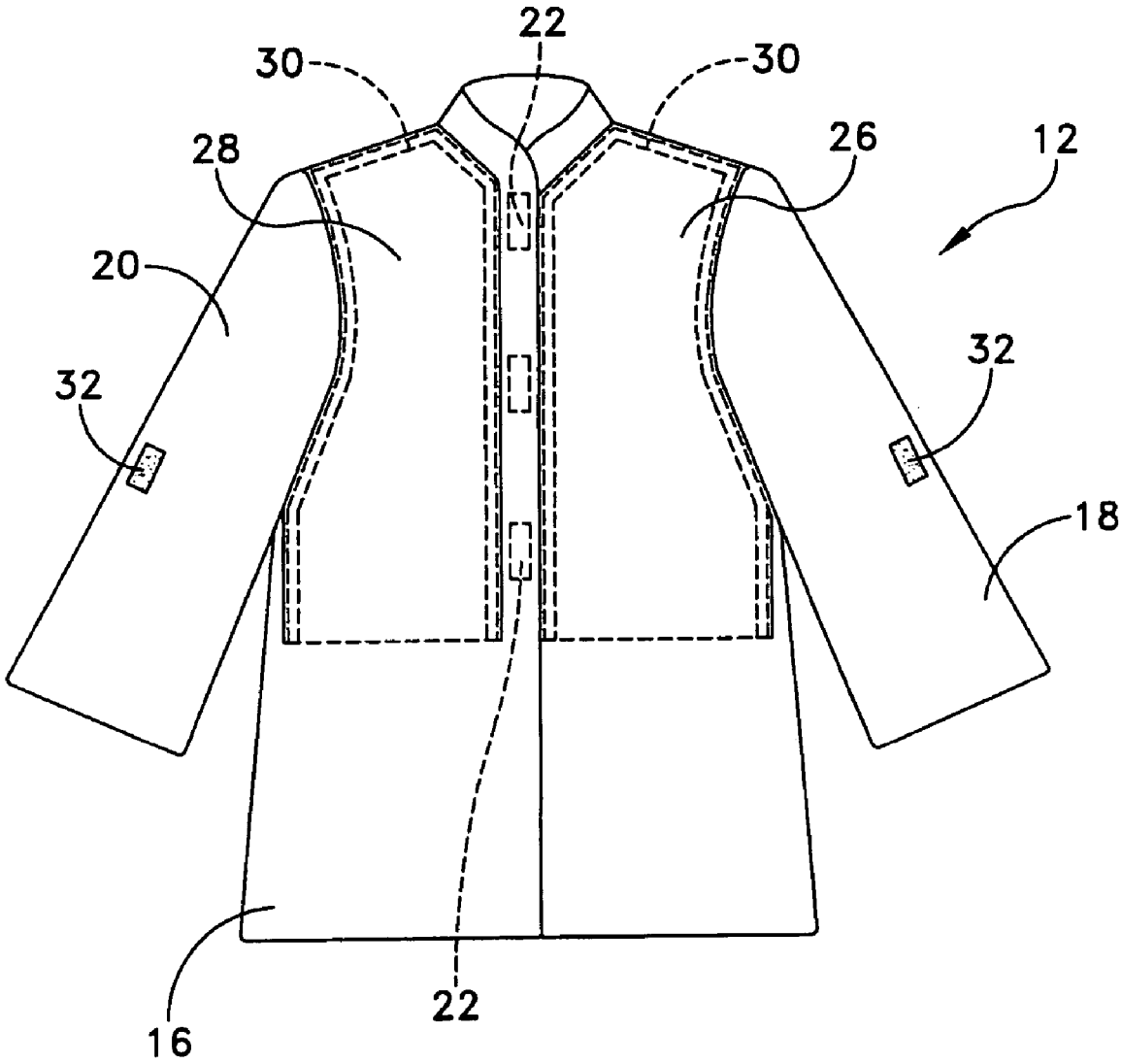
FIG. 2 is a front view of a blouse of the medical garment shown in FIG. 1.

Turning now to FIGS. 1 and 2, the blouse 12 of the medical garment 10 includes fabric material that is configured to cover the upper torso and the arms of the patient. Thus, the blouse 12 has a torso portion 16 and arm portions 18, 20 that are configured in a conventional manner. Although referred to as a blouse, the blouse 12 shown and disclosed herein may also be referred to as a jacket, shirt, top or another similar garment made to cover the upper body of the patient. The blouse may be constructed to cover a portion of or all of the torso and arms of the wearer.

Figure 3:
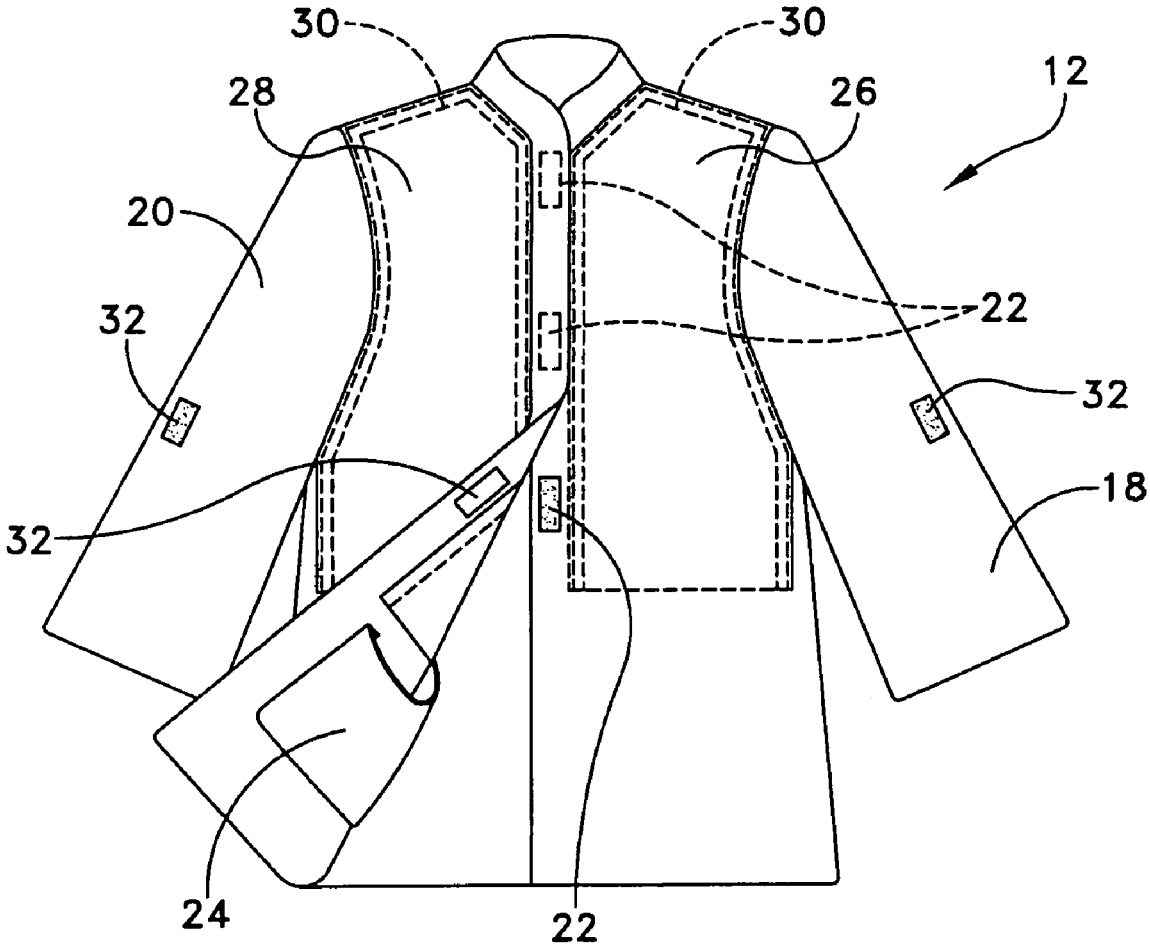
FIG. 3 is a front view showing the attachment of a front of the blouse shown in FIG. 2.

The front of the torso portion 16 is open so that the blouse 12 may be slipped onto the patient by having the patient insert her arms into the arm portions 18, 20. The front of the torso portion 16 includes several, e.g., three, hook and loop fastener devices, each indicated at 22, that are suitably attached (as by sewing) to the torso portion. Each hook and loop fastener device 22 includes a hook portion that is attached, for example, to the inside of the torso portion 16 and a mating loop portion that is attached to the outside of the torso portion. The devices 22 are releasably secured to one another in the well known manner. This construction enables the blouse 12 to be easily put on and taken off by the patient. In another embodiment, mating strips of hook and loop fastener material may be provided in place of the three separate fastener devices. In further embodiments, other types of fasteners, such as snaps, clips, buttons, etc., may be employed. As shown in FIG. 3, the blouse 12 may be provided with an inside pocket 24, which may be used by the patient to store items, such as a medicine bag or valuables, in a relatively secure location.

Figure 4:
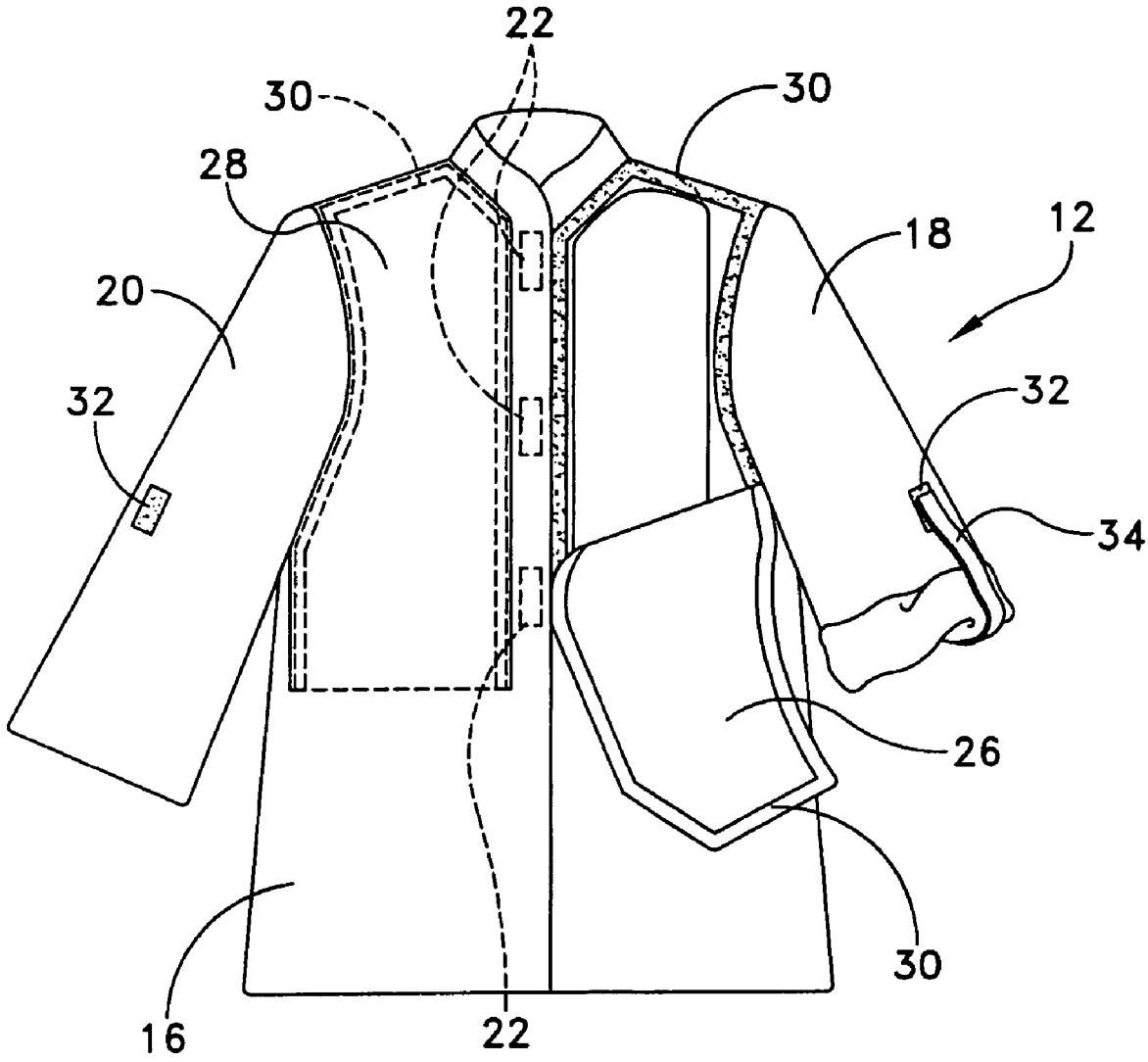
FIG. 4 is a front view showing a breast access panel of the blouse with the breast access panel in an open position.

Referring to FIGS. 4 and 5, in certain embodiments, the blouse 12 may be formed with two breast access panels 26, 28, which are provided in torso portion 16 of the blouse adjacent the breasts of the patient when worn. Each breast access panel 26, 28 extends from the shoulder of the blouse 12 down to the waist, and is movable between a closed position in which the breast access panel is releasably secured to the fabric material (see FIG. 2, for example) and an open position in which the breast access panel is moved away from the fabric material to allow access to the breast of the patient. FIGS. 4 and 5 illustrate the left-side breast access panel 26 in an open position, in which the patient's breast is exposed (FIG. 5) for a medical examination, for example. The right-side breast access panel 28 operates in an identical manner. The result is that a patient requiring a breast examination or other treatment, such as a biopsy, for example, may utilize the garment 10 of the present invention without having to wear a traditional medical garment.

To releasably secure the breast access panels 26, 28 in their closed position, each breast access panel is provided with a hook and loop fastener device indicated at 30, to maintain the panel in its closed position. As shown in FIGS. 4 and 5, the device 30 includes a strip of hook material that is attached, for example, to the inside of the breast access panel 26 or 28 around the periphery of the panel and a mating strip of loop material that is attached to the outside of the torso portion 16 adjacent the shoulder of the wearer. Of course, the hook and loop portions may be reversed (i.e., the loop portion provided on the inside of the breast access panel and the hook portion provided on the outside of the torso portion) and still fall within the scope of the invention. In another embodiment, the strips of hook and loop material may be replaced by several smaller strips or patches of mating hook and loop material. The hook and loop fastener device enable the quick and secure attachment of the breast access panels in their closed positions. Notwithstanding, other types of fasteners as described above may be used in place of the hook and loop fastener material.

Still referring to FIGS. 4 and 5, and in addition to FIG. 6, the arm portions 18, 20 or sleeves of the blouse 12 are configured to be maintained in a rolled-up, out of the way position. As shown, each sleeve may be rolled up and secured in the rolled-up position by another hook and loop fastener device 32. A patch of hook fastener material 32, for example, is secured (as by sewing) to the outside of the arm portion. A mating patch of loop material 32 is secured to a strip of fabric 34 in the manner shown in FIG. 6. The arrangement is such that once a sleeve is rolled up to expose the patient's elbow for drawing blood or receiving treatment, for example, the patch of loop material 32 (or hook material as the case may be) is secured to the patch of hook material 32 (or loop material) to secure the sleeve in its rolled-up position.

Figure 7:
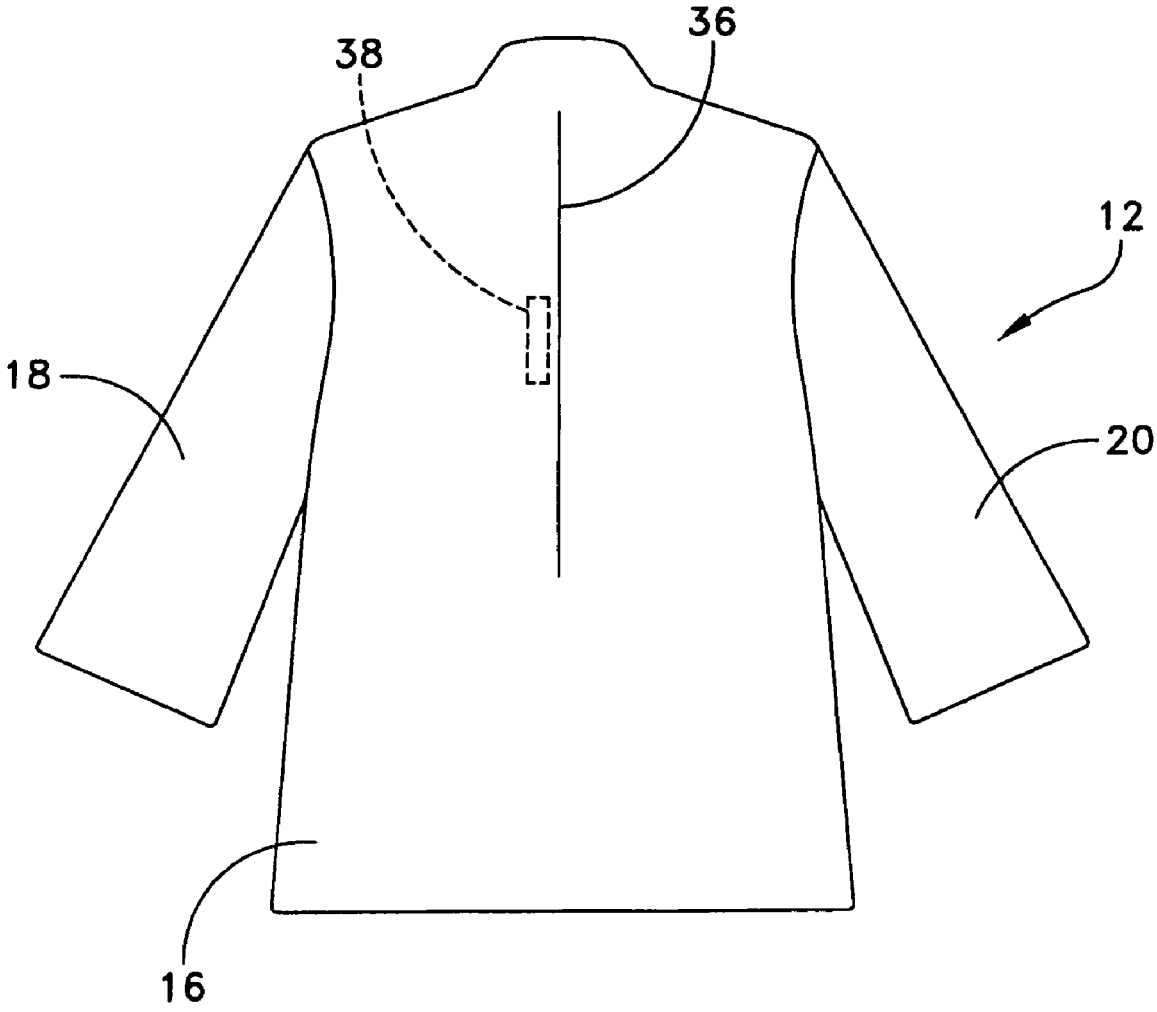
FIG. 7 is a back view of the blouse.
Figure 8:
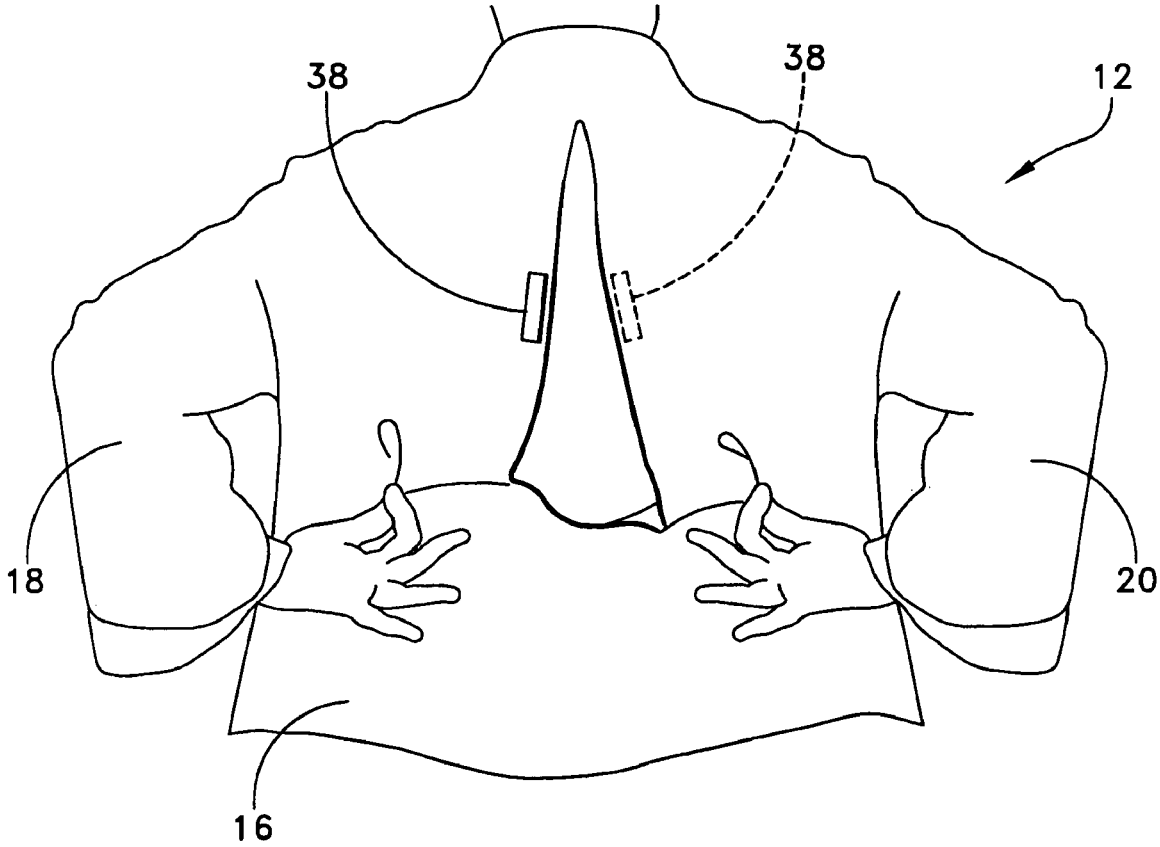
FIG. 8 is a back view of the blouse being worn showing a slit of the blouse in an open position.

With reference to FIGS. 7 and 8, the blouse 12 may be further configured to have a slit 36 formed in the back of the blouse. Specifically, the slit 36 extends vertically at the middle of the patient's back and is provided to enable medical personnel to examine the patient's heart or lungs with a stethoscope, for example. As shown in FIG. 8, the slit 36 may be easily opened by the patient. A fastener device 38 is further provided to secure the slit in a closed position. Specifically, the device 38 includes a mating pair of hook and loop fasteners secured to the blouse adjacent the slit 36. Although one pair of fasteners is shown, any number of mating devices may be provided depending on the length of the slit. In other embodiments, the blouse 12 may include mating strips of hook and loop fastener material running along the length of the slit.

Figure 9:
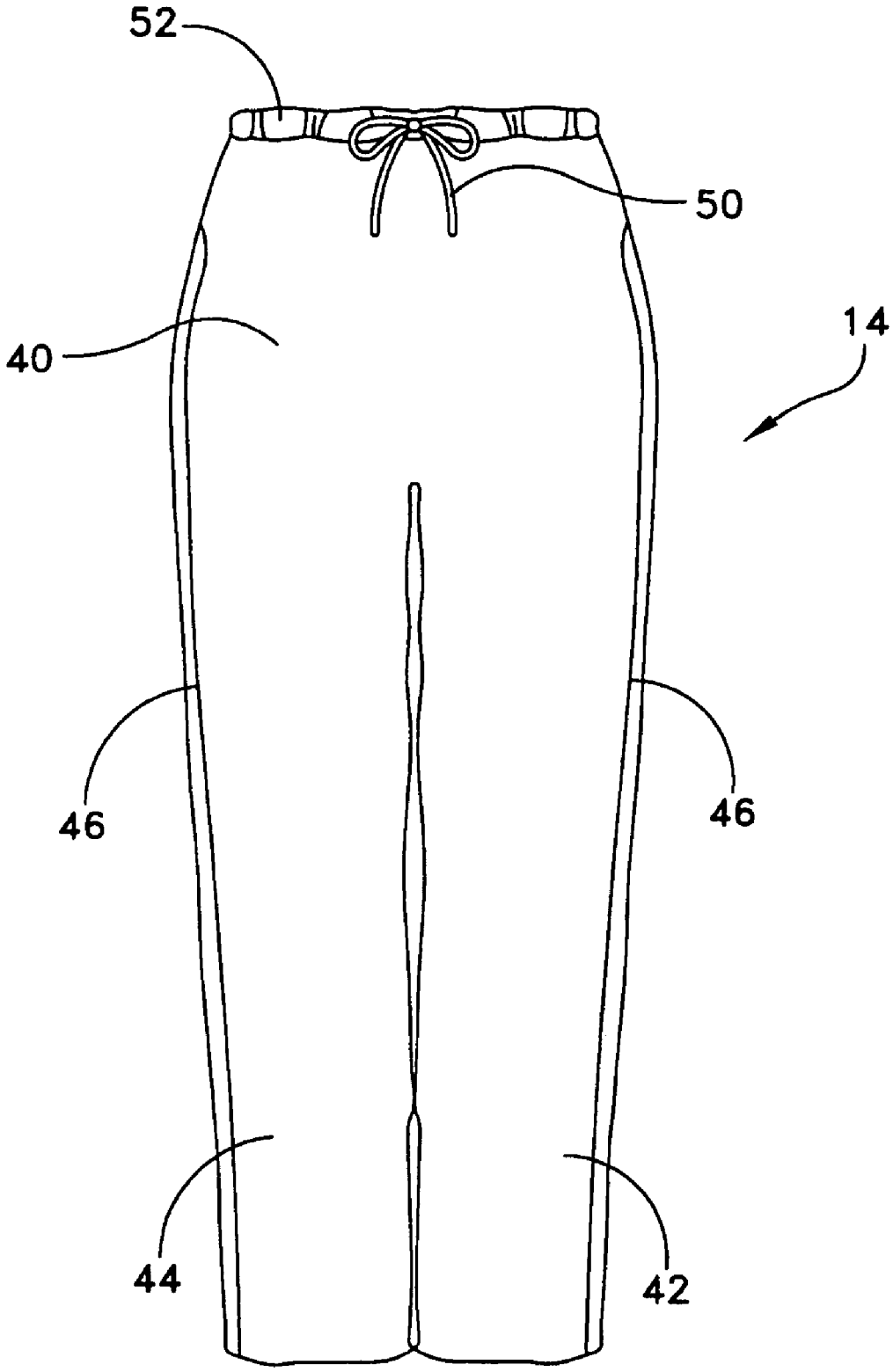
FIG. 9 is a front view of pants of the medical garment shown in FIG. 1.
Figure 10:
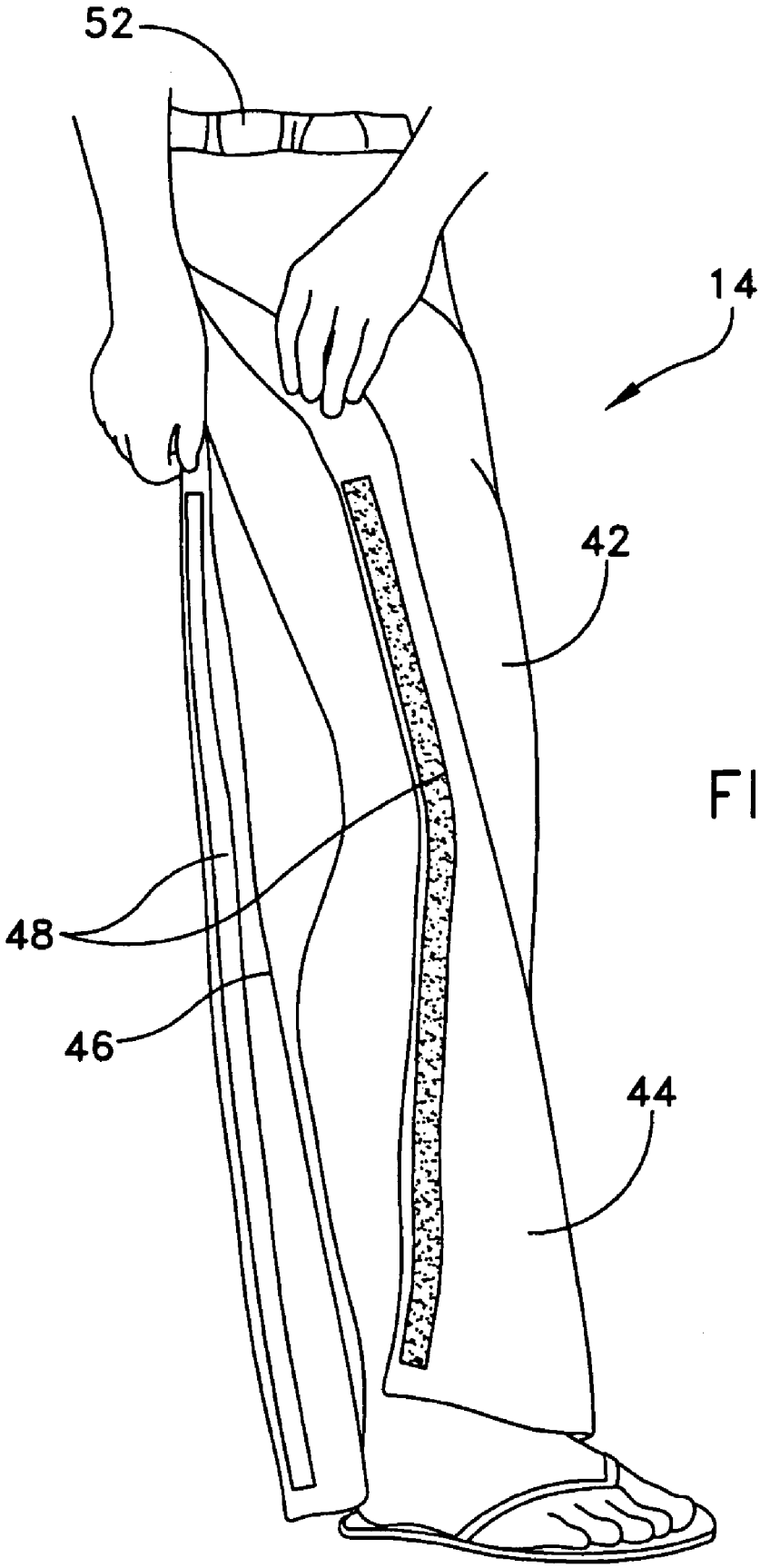
FIG. 10 is a side view of the pants shown in FIG. 9 illustrating a slit in the pants in an open position.

FIGS. 9 and 10 illustrate the pants 14 of the medical garment 10 shown in FIG. 1. The pants 14 include fabric material that is configured to cover all or a portion of the lower torso or waist and the legs of the patient in the conventional manner. Thus, the pants 14 have a lower torso portion 40 and leg portions 42, 44 that are configured in a conventional manner. As with the blouse, although referred to herein as pants, the garment disclosed herein may also be referred to as chinos, slacks, khakis, jeans, denims, or another similar garment made to cover the lower torso and legs of the patient.

As shown in FIG. 10, for each leg portion 42, 44 of the pants 14, a long slit 46 is formed along an outer seam of the fabric material covering the respective leg. The slit 46 is provided to allow easy access to the patient's leg, as well as enabling the pants 14 to be easily slipped on by the patient. Each slit 46 is maintained in a closed position by a fastener 48 provided along the lengths of both sides of the slit. The fastener 48 includes one strip of the hook material and a mating strip of loop material with both strips, as shown, being provided along the length of the slit adjacent the edges of the slit. The strips of the fastener 48 are releasably secured to one another so that the patient may selectively remove lengths of the leg portion 42 and/or 44 away from the patient. Of course, fastener devices having mating patches of hook and loop fastener material (or other types of fasteners) may be provided in place of the strips of material.

Referring back to FIG. 9, the pants 14 further include a draw string 50 that is provided in a closed loop 52 formed in the fabric material at the top of the pants adjacent the lower torso or waist of the patient when worn. In one embodiment, the draw string 50 may be fabricated from string material. In another embodiment, the draw string 50 may be fabricated from elastomeric string material, which enables the drawstring to stretch lengthwise. The draw string 50 may be cinched by the patient to secure the pants 14 around the waist of the patient. In yet another embodiment, the draw string 50 may embody a belt incorporated in the torso portion 40 of the pants 14. The provision of the draw string 50 may also be replaced by any suitable device or assembly, such as an elastic band or fasteners, and fall within the scope of the invention. The provision of the draw string 50 further enables the quick and easy application of the pants 14 on and off of the patient.

Figure 11:
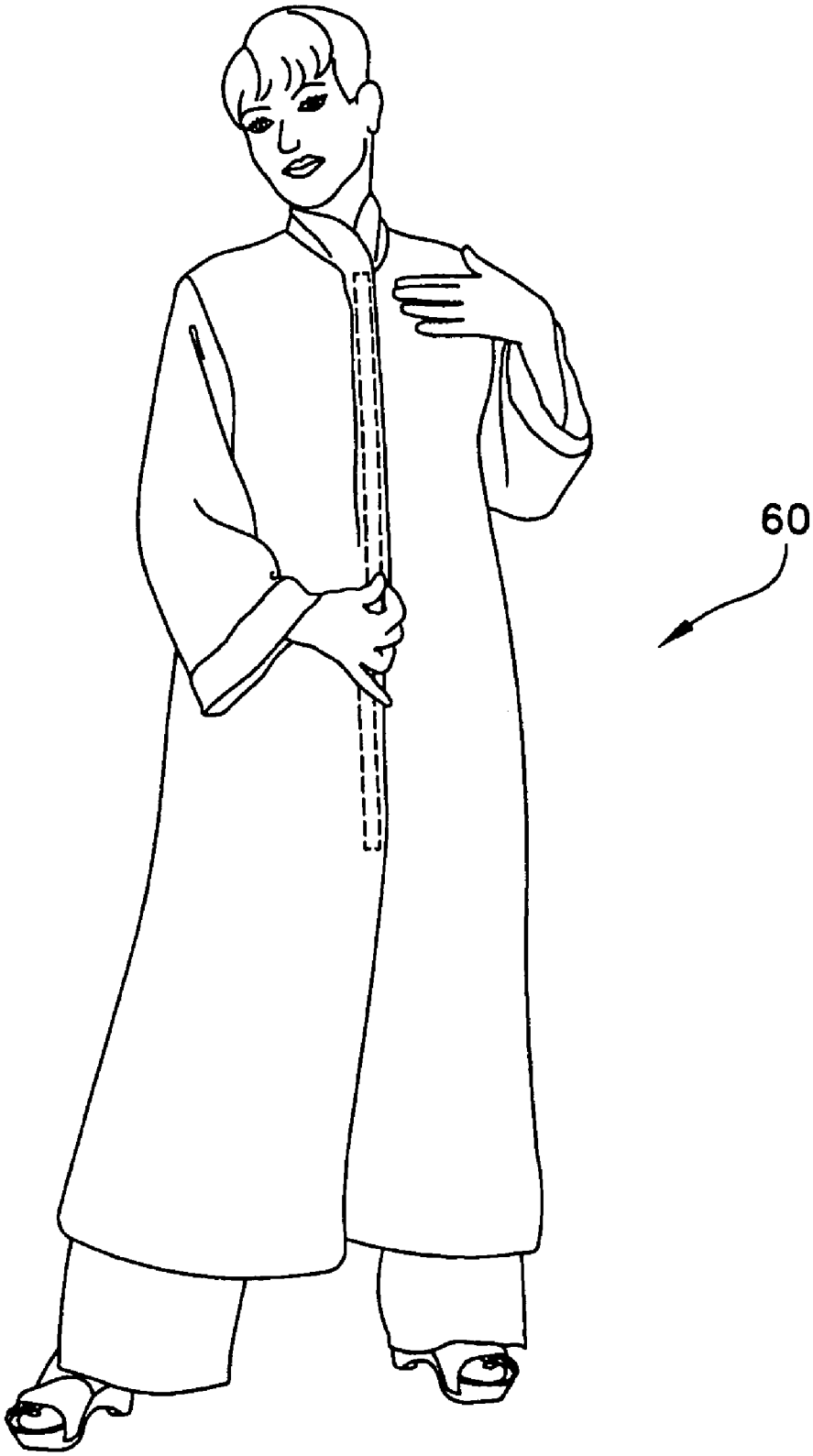
FIG. 11 is a front perspective view of a medical garment of another embodiment of the invention as worn.
Figure 12:
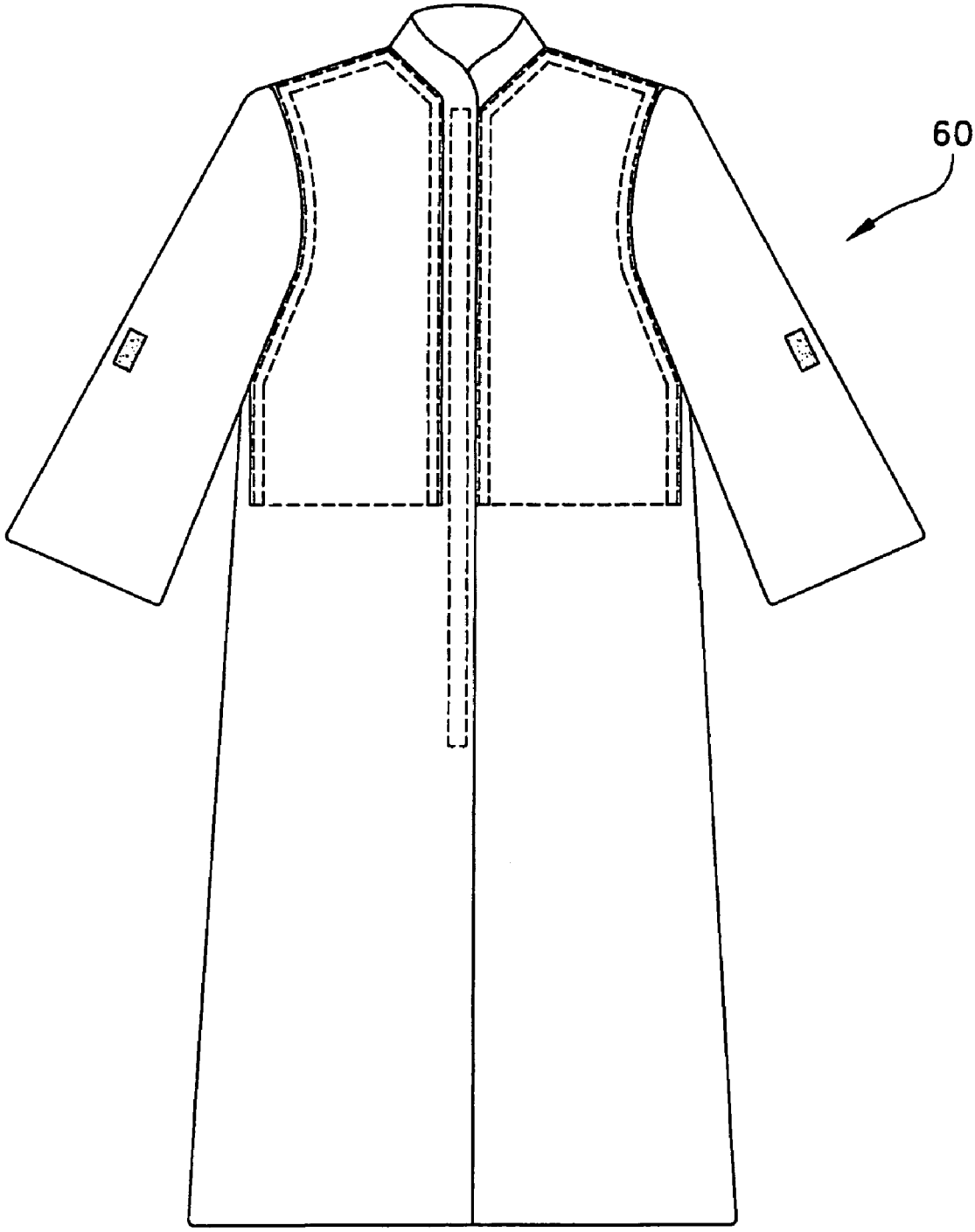
FIG. 12 is a front view of a blouse of the medical garment shown in FIG. 11.

FIGS. 11 and 12 illustrate a medical garment, generally indicated at 60, that is similar to the medical garment 10 shown in FIG. 1. As shown, the difference between medical garment 60 and medical garment 10 is that medical garment 60 is longer in length than medical garment 10. Otherwise, the garments 60 and 10 may be similarly constructed. Particularly, the medical garment 60 is designed to replicate a long coat, for example.

Figure 13:
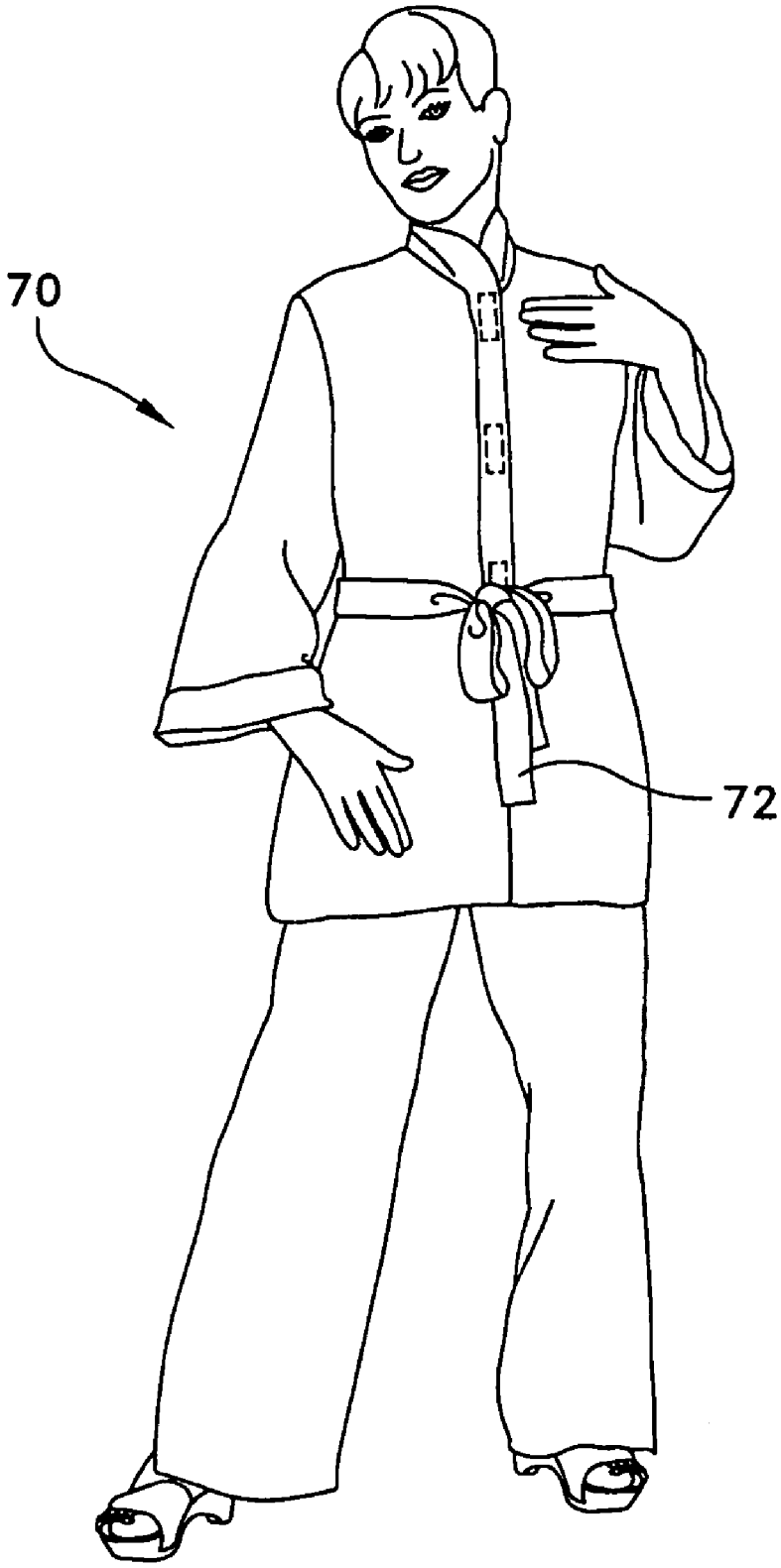
FIG. 13 is a front perspective view of a medical garment of another embodiment of the invention as worn.
Figure 14:
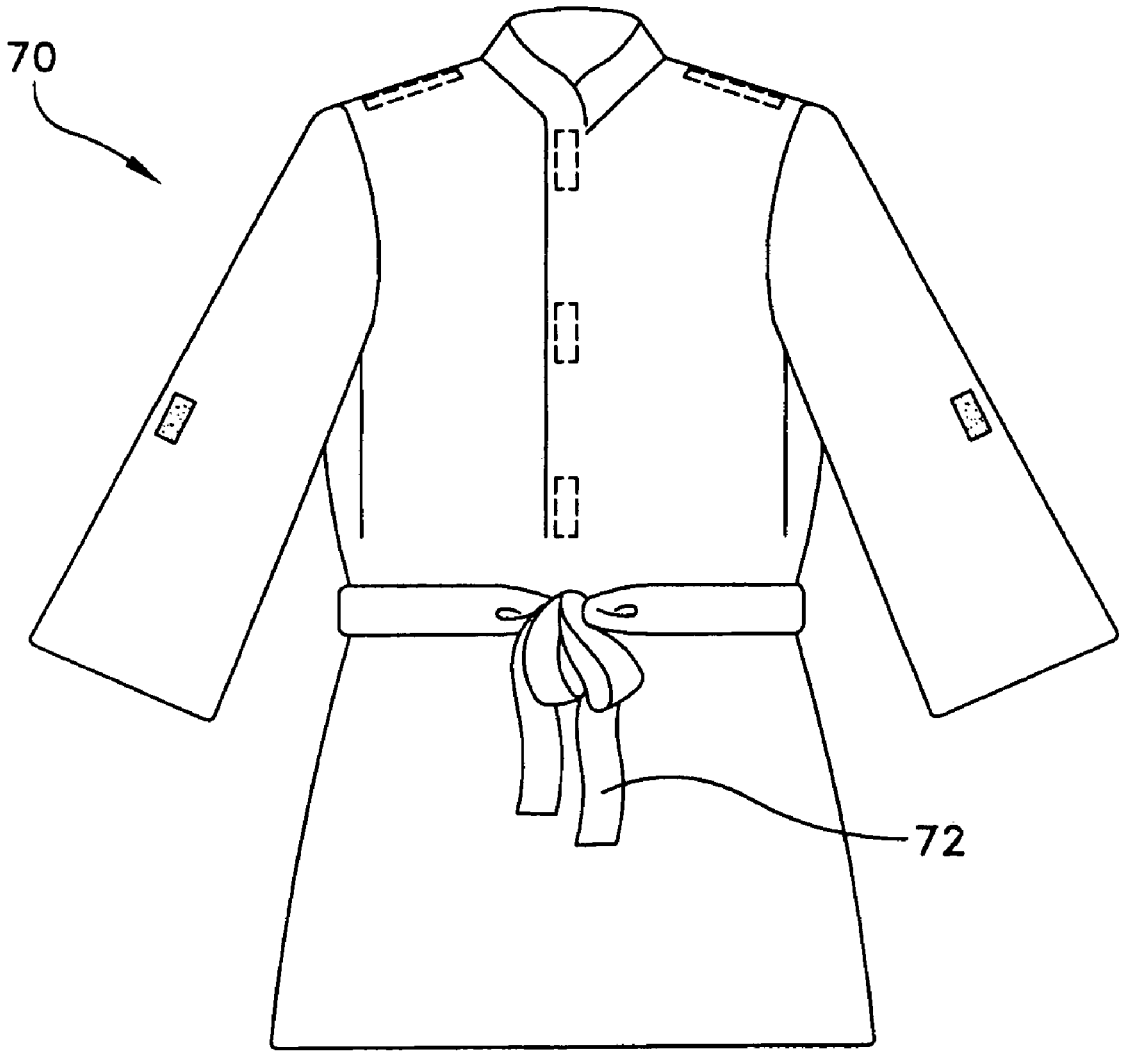
FIG. 14 is a front view of a blouse of the medical garment shown in FIG. 13.

FIGS. 13 and 14 illustrate another style of the medical garment which is generally indicated at 70. As shown, the medical garment 70 is similar to the blouse 12 of the medical garment 10 illustrated in FIG. 2, for example, except for the provision of a belt 72. In addition to securing the garment 70 around the patient's waist, the belt 72 provides a fashion accessory that further distinguishes the medical garment 70 of embodiments of the invention from traditional hospital wear. Loops (not shown) may be provided to assist in securing the belt 72 in place around the waist of the garment 70. The garment 70 may be particularly suited for women to show off their figure. In addition, since garment 70 wraps around the body of the patient, the back slit is not required due to the ease in which the garment may be removed to access the patient's back.

It should be observed that a variety of alternate designs or configurations of the medical garment may be provided and fall within the scope of the instant invention. For example, the preferred devices to releasably secure the breast access panels, the slits in the blouse and pants, as well as the sleeves in their rolled-up positions, are devices incorporating hook and loop fastener material. As known, hook and loop material may be easily manipulated by the patient or medical personnel caring for the patient. However, it should be understood that a person skilled in the art, given the benefit of this disclosure, may replace the devices of hook and loop fastener material with other devices, such as snap fasteners, buttons, buckles, or any other suitable device designed to releasably secure two components to one another. For example, it is envisioned that snap fasteners may be provided to secure the breast access panels in their closed positions.

In addition, the provision of access panels and slits may be provided at any location on the blouse and the pants to access a desired body part. By way of example, an access panel may be provided on the blouse adjacent the upper arm of the patient to access the upper arm for inoculation, for example.

Also, other design choices may be made. For example, the blouses shown in the attached drawings each show cropped collars. The blouse may be configured with a traditional wide collar. Additionally, the blouses and pants may be provided with pockets, which may be utilized by the wearer to store items and provide a design element. Furthermore, as discussed above, various materials may be used to fabricate the medical garments.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A medical garment adapted to be worn by a patient requiring medical attention, the medical garment comprising:

a blouse portion including fabric material configured to cover an upper torso and arms of the patient when worn, the fabric material including a neck portion, a shoulder portion, a torso portion extending from the shoulder portion to a waist of the patient, two arm portions each extending from the shoulder portion, an open front extending from the neck portion through the torso portion to the waist of the patient, the open front being centered on the patient's front when worn, and at least one fastener associated with the open front to maintain the open front in a closed position;

a breast access panel, separate from the open front, formed in the fabric material adjacent a breast of the patient when worn, the breast access panel extending from the shoulder portion to the waist of the patient adjacent the open front, the breast access panel being movable between a closed position in which the breast access panel is releasably secured to the fabric material and an open position in which the breast access panel is moved away from the fabric material to allow access to the breast of the patient;

a strip of hook and loop material attached to an inside of the breast access panel around the periphery of the breast access panel; and a mating strip of hook and loop material attached to an outside of the torso portion of the fabric material configured to releasably secure to the strip of hook and loop material attached to the inside of the breast access panel, wherein the breast access panel is configured to be moved between its open and closed positions while maintaining the open front in its closed position.

2. The medical garment of claim 1, further comprising a slit formed in the fabric material adjacent a back of the patient when worn, and a fastener to releasably secure the slit in a closed position.

3. The medical garment of claim 2, wherein the fastener associated with the slit comprises hook and loop material provided on the fabric material.

4. The medical garment of claim 1, further comprising a pants portion including fabric material configured to cover at least a portion of a lower torso and legs of the patient when worn.

5. The medical garment of claim 4, wherein the pants portion comprises a slit formed in an outer seam of the fabric material, and a fastener to releasably secure the slit in a closed position.

6. The medical garment of claim 5, wherein the fastener associated with the slit comprises hook and loop material provided on the fabric material.

7. The medical garment of claim 1, further comprising a fastener to secure sleeves of the blouse portion in a rolled-up position.

8. The medical garment of claim 1, wherein the torso portion extends beyond the waist of the patient.

9. The medical garment of claim 1, wherein the strip of hook and loop material extends around the entire periphery of the breast access panel and the mating strip of hook and loop material extends around the entire periphery of the outside of the torso portion of the fabric material.

* * * * *